US005671504A

United States Patent [19]

Gou

[11] Patent Number: 5,671,504

[45] Date of Patent: Sep. 30, 1997

[54] WOODEN HANDLE OF GARDENING TOOL

[76] Inventor: Fu-Chi Gou, No. 20, Lane 363, Fu-Chien Rd., Fu-Shin Hsian, Chang-Hua Hsien, Taiwan

[21] Appl. No.: 633,489

[22] Filed: Apr. 17, 1996

[51] Int. Cl.[6] ..... A47B 95/02

[52] U.S. Cl. ..... 16/111 R; 16/DIG. 41; 30/344

[58] Field of Search ..... 16/111 R, 110 R, 16/110.5, DIG. 40, DIG. 41, 109, 116 R; 76/106, 105, 104.1; 87/177.1, 489; 294/57, 58, 59; 30/344, 342

[56] References Cited

U.S. PATENT DOCUMENTS 798,141 8/1905 Morgan et al. ..... 30/344

1,603,584 10/1926 Crook ..... 16/109

2,165,991 7/1939 West ..... 30/344

5,155,913 10/1992 Marttiini ..... 30/342

*Primary Examiner*—Chuck Y. Mah

*Attorney, Agent, or Firm*—Browdy and Neimark

[57] ABSTRACT

A wooden handle of the gardening tool comprises a handle provided at the top thereof with a T-shaped slot. The top of the handle is fitted securely into a reinforcing sleeve. The top end of the handle and the reinforcing sleeve are secured by a protective body of a plastic material. The blade shank of the gardening tool is held securely by the T-shaped slot of the handle and the protective body.

2 Claims, 2 Drawing Sheets

WOODEN HANDLE OF GARDENING TOOL

FIELD OF THE INVENTION

The present invention relates generally to a gardening tool, and more particularly to a wooden handle of the gardening tool.

BACKGROUND OF THE INVENTION

As shown in FIG. 1, a wooden handle 11 of the prior art gardening shears is provided at the top thereof with a round hole 110 which is covered with a metal cap 12. A shears handle 13 is held securely in the round hole 110. In order to accommodate the round hole 110, a wooden handle 11 of a large diameter is generally used. The large wooden handle 11 is undesirable esthetically. In addition, it is difficult for a person, especially the one with small hands, to get a firm grip of the large wooden handle 11.

SUMMARY OF THE INVENTION

It is therefore the primary objective of the present invention to provide a gardening tool with a wooden handle capable of engaging securely the shank of the blade of the gardening tool.

It is another objective of the present invention to provide a gardening tool with a wooden handle which is as good as an iron handle and is desirable esthetically.

It is still another objective of the present invention to provide a gardening tool with a wooden handle which can be made at a low cost.

The foregoing objectives of the present invention are attained by a wooden handle, which is provided at the top thereof with a T-shaped slot. The top of the wooden handle is fitted into a reinforcing sleeve. The reinforcing sleeve and the top end of the wooden handle are secured by a protective body of a plastic material. The blade shank of the gardening tool is held securely by the T-shaped slot and the protective body.

The foregoing objectives, features, functions and advantages of the present invention will be more readily understood upon a thoughtful deliberation of the following detailed description of the present invention in conjunction with the accompanying drawings.

DETAILED DESCRIPTION OF THE INVENTION

Figure 1:
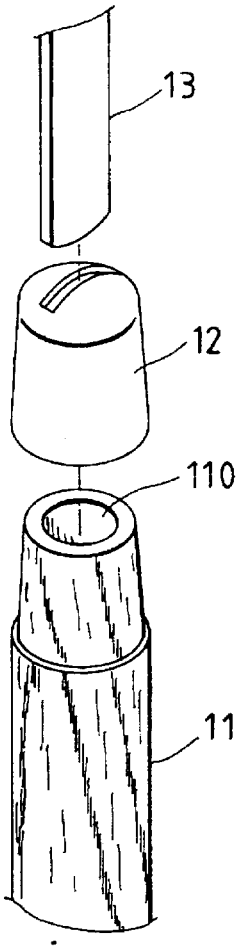
FIG. 1 (PRIOR ART)
FIG. 1 shows a perspective view of a wooden handle and a blade shank of a gardening tool of the prior art.
Figure 2:
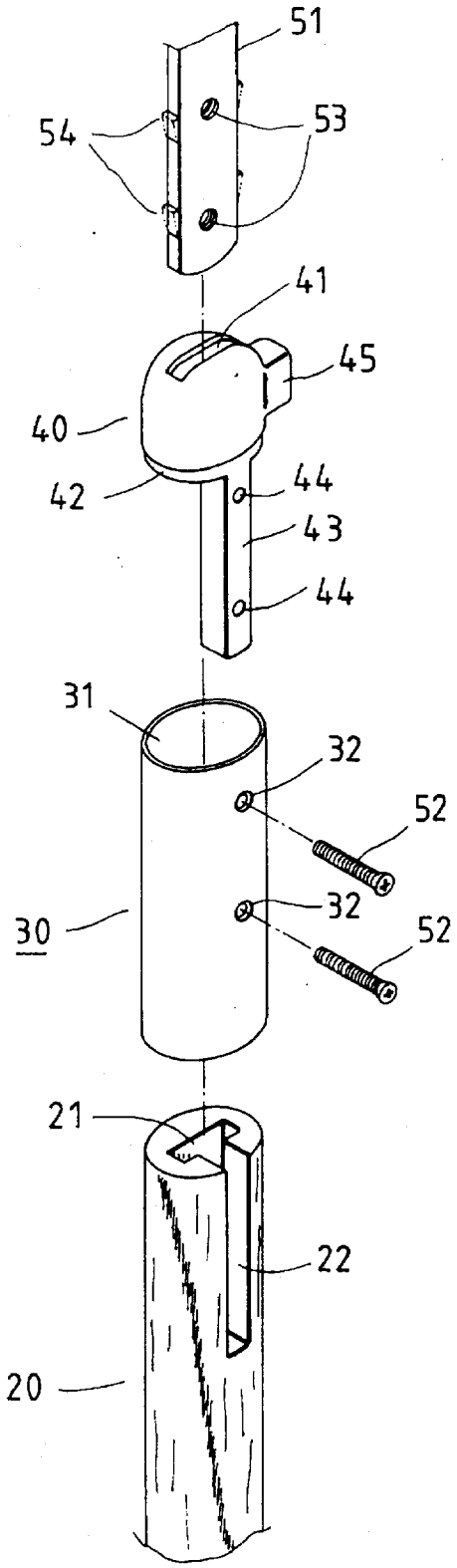
FIG. 2 shows an exploded view of a wooden handle of the present invention for use as a wooden handle of a gardening tool.
Figure 4:
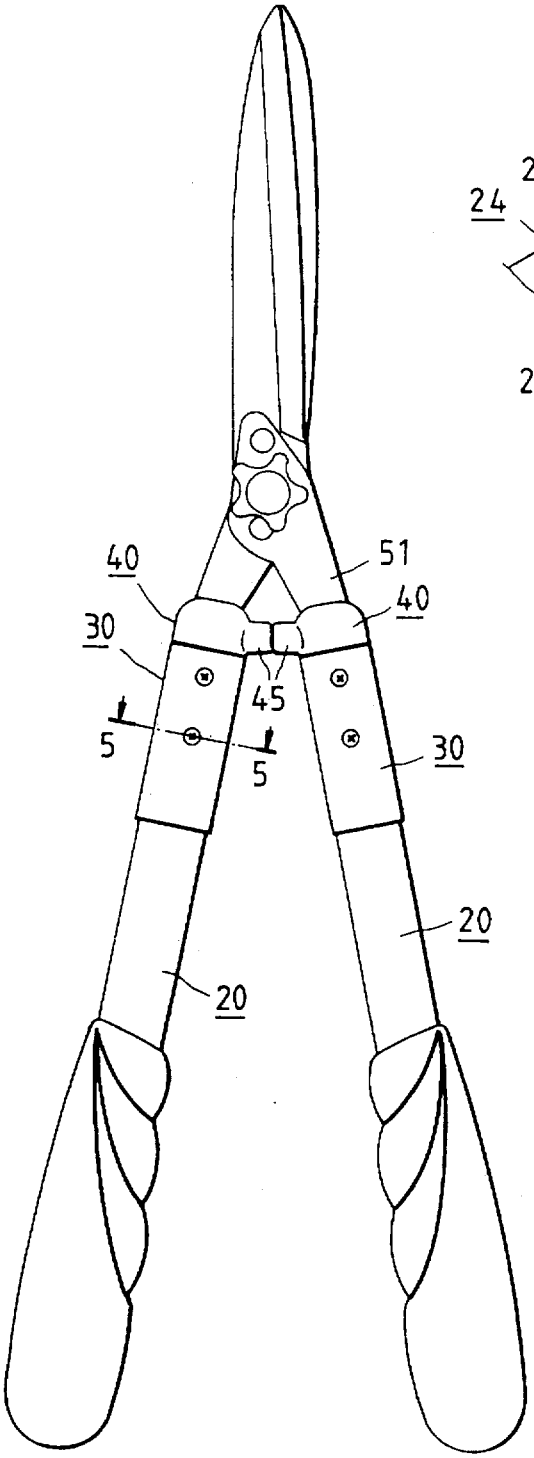
FIG. 4 shows a perspective view of the wooden handles of the present invention in conjunction with a gardening tool.

As shown in FIG. 2, a wooden handle of the present invention comprises a handle 20, a reinforcing sleeve 30, and a protective body 40.

Figure 3:
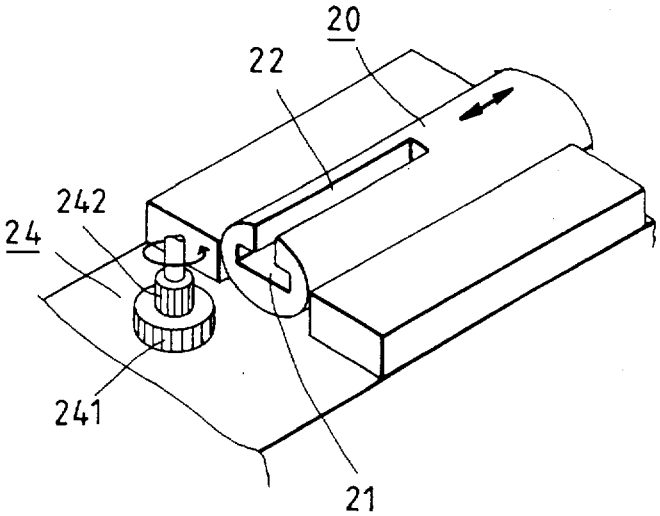
FIG. 3 shows a schematic view of the construction of the wooden handle of the present invention.
Figure 5:
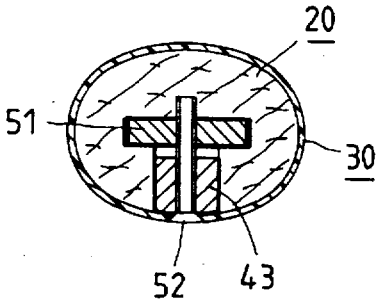
FIG. 5 shows a sectional view of a portion as shown by the line 5—5 in FIG. 4.

The handle 20 of a wood material is oval in its cross section and is provided at the top thereof with a slot having a T-shaped cross section. The slot comprises an axial slot 21 and a side slot 22. The T-shaped slot of the handle 20 is made by placing the handle 20 on a machine platform such that the top end of the handle 20 is put through a high speed cutter 24, as shown in FIG. 3. The cutter 24 has two blades 241 and 242 for finishing the formation of the axial slot 21 and the side slot 22 at the same time. The axial slot 21 has a cross section similar in shape to the cross section of the blade shank of a gardening tool.

The oval reinforcing sleeve 30 of a metal or rigid material is fitted over the top end of the handle 20 for reinforcing the top end of the handle 20. The reinforcing sleeve 30 is provided at the top thereof with a top hole 31 and in the side wall thereof with two round holes 32.

The protective body 40 is made integrally of a plastic material and is provided at the center of the top thereof with a top slot 41 corresponding in location to the axial slot 21 of the handle 20. The protective body 40 is provided at the bottom thereof with a bottom edge 42 which is fitted into the top hole 31 of the reinforcing sleeve 30. The protective body 40 is further provided with a rod 43 extending downwards and having two round holes 44, and with a stopping block 45.

The wooden handle of the present invention is characterized in that the axial slot 21 of the handle 20 and the top slot 41 of the protective body 40 have a cross section similar in shape to the cross section of a blade shank 51. The handle 20 and the blade shank 51 can be fastened securely by a plurality of screws 52 which are received in the round holes 32 and 44, and the threaded holes 53. The blade shank 51 is provided with a plurality of inverted hooks 54 for reinforcing the fastening effect of the blade shank 51.

The wooden handle of the present invention is provided with the engaging slots having a cross section similar in shape to the cross section of the blade shank of a gardening tool. In addition, the wooden handle of the present invention comprises a thick side which is exerted on by the shearing force, and a thin side which is not exerted on by the shearing force. As a result, the overall thickness of the wooden handle of the present invention is significantly reduced without undermining the structural strength of the wooden handle. The production of the wooden handle of the present invention requires less amount of wood in view of the fact that the wooden handle of the present invention is oval, not square, in its cross section. The saving of the wood material can be up to 50% or more. As a result, the cost of making the wooden handle of the present invention is relatively low. Moreover, the wooden handle of the present invention is esthetically superior to the prior art wooden handle.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A wooden handle of a gardening tool, said wooden handle comprising:

a handle of a wood material and provided at one end thereof with a slot formed by an axial slot and a side slot such that said slot has a T-shaped cross section;

a reinforcing sleeve fitted over said one end of said handle; and a protective body engaged to said handle and said reinforcing sleeve, said protective body provided with a top slot corresponding in location to said axial slot of said handle and adapted to be engaged to a blade shank of a gardening tool, wherein said protective body is provided with a rod made integrally therewith, wherein said rod of said protective body is engaged in said side slot of said handle.

2. The wooden handle as defined in claim 1, wherein said handle and said reinforcing sleeve have an oval cross section.

* * * * *